US007789701B2

(12) United States Patent
Murr et al.

(10) Patent No.: US 7,789,701 B2
(45) Date of Patent: Sep. 7, 2010

(54) PANEL MOUNTABLE CONNECTOR ASSEMBLY

(75) Inventors: Keith McQuilkin Murr, York, PA (US); Scott S. Duesterhoeft, Etters, PA (US); Robert N. Mulfinger, York Haven, PA (US); Lee Jacobo Jose Roitberg, Austin, TX (US)

(73) Assignee: Tyco Electronics Corporation, Berwyn, PA (US)

( * ) Notice: Subject to any disclaimer, the term of this patent is extended or adjusted under 35 U.S.C. 154(b) by 55 days.

(21) Appl. No.: 12/128,551

(22) Filed: May 28, 2008

(65) Prior Publication Data

US 2009/0298332 A1 Dec. 3, 2009

(51) Int. Cl.
*H01R 13/73* (2006.01)

(52) U.S. Cl. ..... 439/552

(58) Field of Classification Search ..... 439/544, 439/545, 548, 549, 552–557, 562–567, 569, 439/570, 571, 95, 607.28
See application file for complete search history.

(56) References Cited

U.S. PATENT DOCUMENTS

| | | | | |
|---|---|---|---|---|
| 5,238,426 | A * | 8/1993 | Arnett | 439/557 |
| 5,803,758 | A * | 9/1998 | Kameyama | 439/248 |
| 6,030,242 | A | 2/2000 | Cunningham et al. | |
| 6,176,738 | B1 | 1/2001 | Consoli et al. | |
| 6,312,285 | B1 | 11/2001 | Berg et al. | |
| 6,343,947 | B1 * | 2/2002 | Byrne | 439/357 |
| 7,137,847 | B2 | 11/2006 | Trout et al. | |
| 7,168,978 | B1 | 1/2007 | Trout et al. | |
| 7,597,587 | B1 * | 10/2009 | Duesterhoeft | 439/545 |

* cited by examiner

*Primary Examiner*—Ross N Gushi

(57) ABSTRACT

A connector assembly adapted for mounting to a panel having a cutout includes a connector having a body including sides defining a perimeter configured to fit within the cutout. The connector includes a flange extending outward from one of the sides of the body, and the flange is configured to engage a front surface of the panel to define a stop against the panel when the connector is in a mated position. The connector is configured to be one of either front loaded through the cutout from a front of the panel to the mated position or rear loaded through the cutout from a rear of the panel to the mated position.

21 Claims, 5 Drawing Sheets

PANEL MOUNTABLE CONNECTOR ASSEMBLY

BACKGROUND OF THE INVENTION

The subject matter herein relates generally to connector assemblies, and more particularly, to connector assemblies mountable to a panel by front loading and rear loading operations.

Some electrical systems and devices today are designed to include ports along the panels or walls of an electrical system or device, such as a portable computer. The ports allow an operator of the system to establish a communication or transmission line to a peripheral device (e.g., an RF antenna, a wireless device, a wireless router, another system). In addition, the ports may allow the operator to establish a power connection for the system or the peripheral device. The system includes a connector assembly that holds contacts configured to mate with a mating connector that is coupled to the peripheral device. The connector assembly is typically mounted to either the front side, or the back side, of the panel using hardware, such as screws, clips, pins, and the like. However, the hardware used for mounting may increase the amount of time and cost to construct the system. Alternatively, when hardware is not used to attach the conventional receptacle to the panel, the receptacle may inadvertently disengage from the panel during normal use of the system.

In some known systems, the connector assembly is mounted to a panel having a cutout. Some known connector assemblies are front loaded into the cutout by loading the connector assembly directly through the cutout from the front of the panel. Other known connector assemblies are rear loaded into the cutout by loading a projection of the connector assembly through a notch in the cutout and then sliding the connector assembly in a direction parallel to the panel. The panel is typically captured between the projection at the front of the panel, and a corresponding projection of the connector assembly at a rear of the panel. Such connectors are referred to as slide-to-lock connectors. The front loaded connector assemblies are not configured to be rear loaded, and the rear loaded connector assemblies are not configured to be front loaded. As such, two different connector assemblies must be designed to accommodate different customers having different mounting requirements.

Thus, there is a need for a connector assembly that may be assembled in more than one way or using more than one type of loading operation. There is a need for a connector assembly that may be easier for a user to mount to a panel than conventional mountable connector assemblies.

BRIEF DESCRIPTION OF THE INVENTION

In one embodiment, a connector assembly is provided and is adapted for mounting to a panel having a cutout. The connector assembly includes a connector having a body including sides defining a perimeter configured to fit within the cutout. The connector includes a flange extending outward from one of the sides of the body, and the flange is configured to engage a front surface of the panel to define a stop against the panel when the connector is in a mated position. The connector is configured to be one of either front loaded through the cutout from a front of the panel to the mated position or rear loaded through the cutout from a rear of the panel to the mated position.

Optionally, front loading of the connector may be accomplished by loading the connector in a loading direction generally perpendicular to the front surface of the panel, and rear loading may be accomplished by loading the connector in a loading direction non-orthogonal to the front surface. The mated position of the connector with respect to the panel may be the same when the connector is front loaded and when the connector is rear loaded. Optionally, the body may include a mating end, and the flange may extend from the respective side proximate the mating end. The body may include at least two flanges, with each flange having an engagement surface being substantially coplanar with each other engagement surface. The engagement surfaces may engage the front surface of the panel. Optionally, the connector may include at least one spring beam associated with the flange with each spring beam engaging a rear surface of the panel. The connector may include a mating cavity open at a mating end of the body for a cavity length measured along the side having the flange, wherein the flange extends along the respective side for a length that is longer then the cavity length. The flange may extend along at least a majority of the side having the flange.

In another embodiment, a connector assembly adapted for mounting to a panel having a cutout is provided that includes a connector having a body including sides defining a perimeter configured to fit within the cutout. The connector includes a flange extending outward from one of the sides of the body, and the flange has a first end and a second end facing opposite sides of the body. The connector is configured to be loaded through the cutout in a loading direction by initially loading the first end of the flange through the cutout and then moving the connector in the loading direction that is defined at a non-orthogonal angle with respect to a front surface of the panel to a loaded position in which the second end of the flange has clearance from a rear surface of the panel. The connector is moved from the loaded position to a mated position in a mating direction in which the first end is moved toward the front surface.

In a further embodiment, a connector assembly is provided that includes a planar panel having a front surface and a rear surface and having a cutout extending along and within the panel between the front and rear surfaces. The connector assembly also includes a connector having a body including sides defining a perimeter configured to fit within the cutout. The connector includes a first flange extending outward from one of the sides of the body and a second flange extending outward from an opposite one of the sides of the body. The connector is mounted to the panel in a mated position such that the flanges engage the front surface of the panel. The connector is one of either front loaded through the cutout from a front of the panel to the mated position or rear loaded through the cutout from a rear of the panel to the mated position.

DETAILED DESCRIPTION OF THE INVENTION

Figure 1:
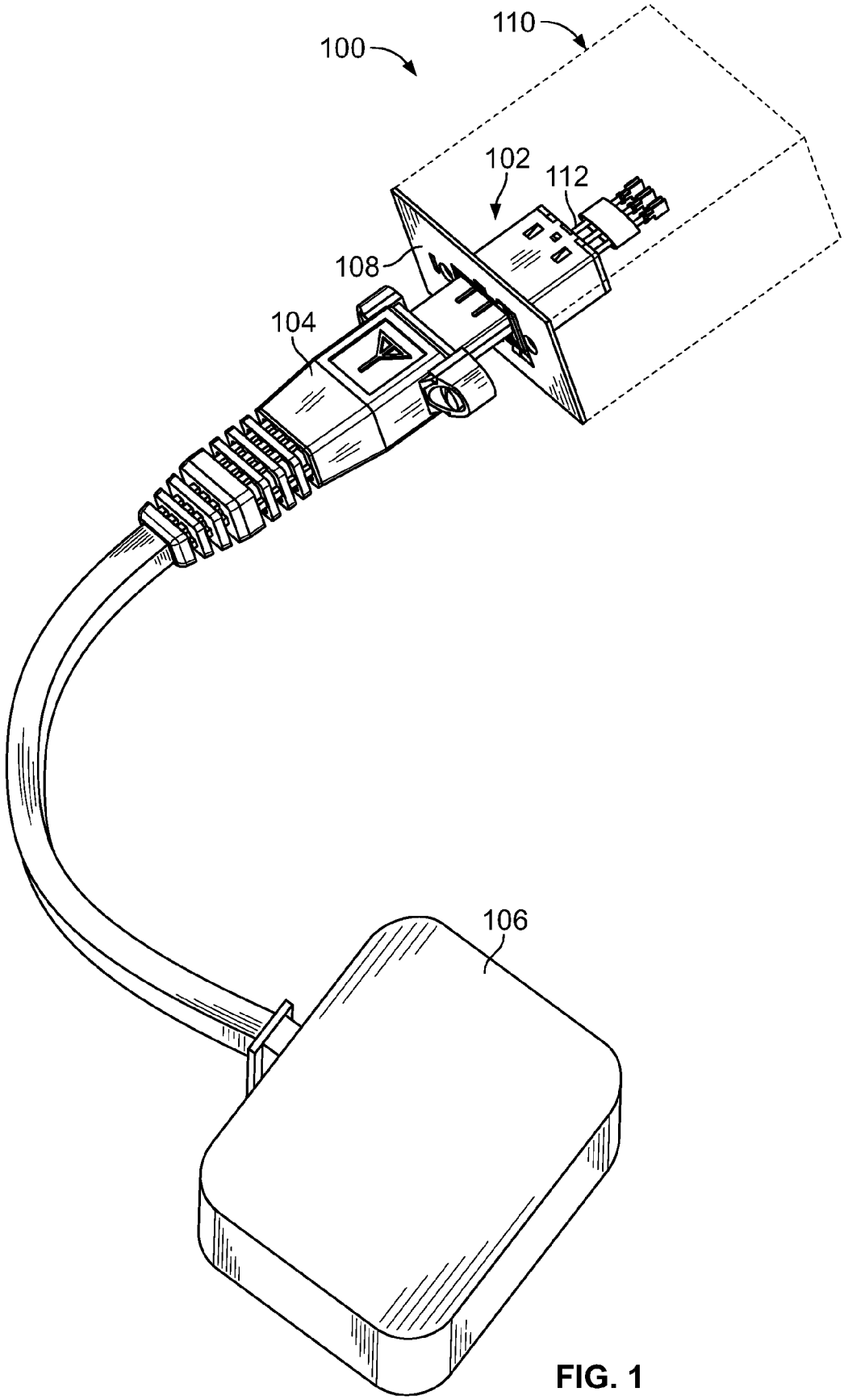
FIG. 1 illustrates an electrical connector system having a connector assembly and a mating connector of a peripheral device adapted for mating with the connector assembly.

FIG. 1 illustrates an electrical connector system 100 having a connector assembly 102 and a mating connector 104 of a peripheral device 106 adapted for mating with the connector assembly 102. The connector assembly 102 is mounted to a panel 108 of a host device or system 110. The connector assembly 102 is in electrical communication with the host system 110 via transmission/power lines 112. The host system 110 may be, for example, a portable computer. The panel 108 at least partially separates an interior of the host system 110 from an exterior of the host system 110.

The connector assembly 102 may be securely mounted to the panel 108 to provide an interface to the host system 110 for the peripheral device 106. The mating connector 104 of the peripheral device 106 engages and/or mates with the connector assembly 102 to electrically connect the peripheral device 106 and the host system 110, such as to allow communication therebetween. In an exemplary embodiment, the peripheral device 106 may be an RF antenna or other wireless device that is utilized by the host system 110 to operate. However, the connector assembly 102 may be utilized to interface with other types of devices and/or systems. The peripheral device 106 is thus illustrative and is not intended to be limiting or restrictive in any manner.

In an exemplary embodiment, the mating connector 104 defines a plug type connector and the connector assembly 102 defines a receptacle type of connector that receives the mating connector 104. The connector assembly 102 and the mating connector 104 may include complementary mating contacts (not shown) that are configured to engage with one another. In an exemplary embodiment, the connector assembly 102 and the mating connector 104 are multi-port QSL type connectors, such as those developed by Tyco Electronics Corporation. However, the connector assembly 102 and the mating connector 104 may be any type of electrical connectors, including electro-optical connectors.

Figure 2:
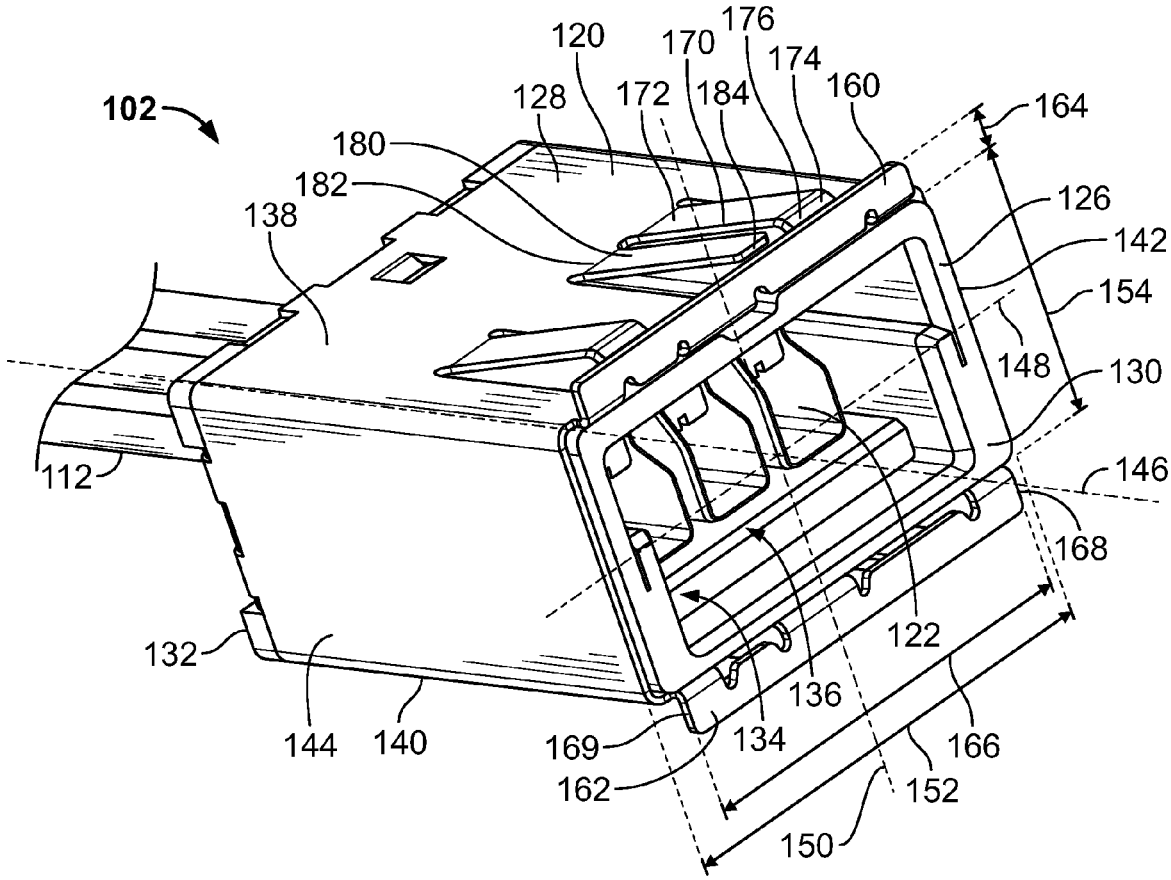
FIG. 2 is a front perspective view of the connector assembly shown in FIG. 1.

FIG. 2 is a front perspective view of the connector assembly 102 including a body 120 and a plurality of contacts 122 held within the body 120. Three contacts 122 are illustrated in FIG. 2, however any number of contacts 122 may be provided in alternative embodiments. The contacts 122 are configured for mating engagement with mating contacts (not shown) of the mating connector 104 (shown in FIG. 1). In an exemplary embodiment, each contact 122 is terminated to an end of the lines 112, however the contacts 122 may be board mounted or may be configured to receive another contact in alternative embodiments.

In an exemplary embodiment, the body 120 includes a dielectric housing portion 126 and a shield portion 128 surrounding the housing portion 126. The shield portion 128 is a conductive shield and is adapted to provide shielding around the housing portion 126, such as from electromagnetic interference. In alternative embodiments, the body 120 may be provided without the shield portion 128 or without the housing portion 126. For example, the body 120 may be of a one-piece construction.

The body 120 includes a mating end 130 at a front of the body 120, and a rear end 132 opposite to the mating end 130. The lines 112 extend from the rear end 132. The body 120 includes a mating cavity 134 and an opening 136 to the mating cavity 134 at the mating end 130. The contacts 122 are held by the body 120 within the mating cavity 134 and the mating cavity 134 is configured to receive the mating connector 104 in operation. In an exemplary embodiment, the body 120 is generally box-shaped and includes four sides that define an outer perimeter of the body 102, namely a top side 138, a bottom side 140, and opposed first and second sides 142, 144. The first and second sides 142, 144 are generally parallel to one another and perpendicular to the top and bottom sides 138, 140. In alternative embodiments, more or less than four sides may be provided and the body may have other shapes other than a box-shape. While the illustrated embodiment is designed for horizontal mounting of the connector assembly to the panel 108, with the top generally upward facing and the bottom generally downward facing, it is realized that alternative mounting orientations are possible, such as vertical mounting or mounting up-side down. As such, the terms top, bottom, upper, lower, upward, downward and the like are relative and based on the orientation of the illustrated embodiment, and are not intended to be restrictive. For example, if the connector assembly 100 were mounted upside down, the top side 138 may be positioned generally vertically below the bottom side 140.

The body 120 extends along a contact axis 146 that extends generally between the mating end 130 and the rear end 132. The mating connector 104 is loaded into the mating cavity 134 along the contact axis 146. The body 120, particularly at the mating end 130, extends along a longitudinal axis 148 that is perpendicular to the contact axis 146 and a lateral axis 150 that is perpendicular to the contact axis 146 and the longitudinal axis 148. In the illustrated embodiment, the body 120 is generally elongated in a horizontal direction such that the top and bottom sides 138, 140 are generally longer than the first and second sides 142, 144. The longitudinal axis 148 is thus parallel to the top and bottom sides 138, 140 and the lateral axis 150 is parallel to the first and second sides 142, 144. The top and bottom sides 138, 140 extend along the longitudinal axis 148 for a length 152 and the first and second sides 142, 144 extend along the lateral axis 150 for a length 154.

In an exemplary embodiment, the body 120 includes a top flange 160 extending outward from the top side 138 of the body 120 and a bottom flange 162 extending outward from the bottom side 140 of the body 120. Optionally, the top and bottom flanges 160, 162 may be positioned adjacent to the mating end 130 of the body 120. Alternatively, the top and bottom flanges 160, 162 may be positioned remote from the mating end 130 such that at least a portion of the body 120 extends forward of the top and bottom flanges 160, 162. The top and bottom flanges 160, 162 each have a height 164 defined from the top side 138 and the bottom side 140, respectively. The top and bottom flanges 160, 162 each have a length 166 extending between opposed first and second ends 168, 169 of the flanges along the longitudinal axis 148. Optionally, the length 166 may be approximately equal to the length 152 of the top and bottom sides 138, 140. Optionally, the length 166 may be longer than a length of the opening 136 to the mating cavity 134. In the illustrated embodiment, the top and bottom flanges 160, 162 are integrally formed with the shield portion 128 of the body 120 and the top and bottom flanges 160, 162 are substantially identical to one another. For example, the shield portion 128, including the top and bottom flanges 160, 162, is stamped and formed from a blank of metal stock material. In alternative embodiments, the top and bottom flanges 160, 162 may be integrally formed with the housing portion 126 or may be separately formed and coupled to the shield portion 128 and/or the housing portion 126. The top and bottom flanges 160, 162 may be sized and/or shaped differently with respect to one another. The top and bottom flanges 160, 162 may be positioned at different locations along the contact axis 146 with respect to one another. Such features may provide keying or polarization when mounting the connector assembly 102 to the panel 108 (shown in FIG. 1).

The body 120 includes a plurality of spring beams 170 extending from the top side 138. Similar spring beams also extend from the bottom side 140, but are not shown in FIG. 2. Two spring beams 170 are illustrated the embodiment shown in FIG. 2, however any number of spring beams 170 may be provided in alternative embodiments. The spring beams 170 are positioned proximate to the first and second sides 142, 144. As described in further detail below, the spring beams 170 cooperate with the top flange 160 to hold the connector assembly 102 in position with the panel 108. For example, the spring beams 170 may be resilient and/or flexible and provide a biasing force against the panel 108 when the connector assembly 102 is mounted to the panel 108. Each spring beam 170 defines a cantilevered beam that is attached to the body 120 at a fixed end 172. A distal end 174 of each spring beam 170 is freely movable and is configured to engage the panel 108 when the connector assembly 102 is mounted to the panel 108. In an exemplary embodiment, the distal end 174 of each of the spring beams 170 is radiused or curved to define a forward abutment surface 176 for engaging the panel 108.

The spring beams 170 are angled outward from the body 120 such that the distal ends 174 are spaced apart from the top side 138. In an exemplary embodiment, the spring beams 170 are integrally formed with the shield portion 128 of the body 120. For example, the shield portion 128, including the spring beams 170, is stamped and formed from a blank of metal stock material. In alternative embodiments, the spring beams 170 may be integrally formed with the housing portion 126 or may be separately formed and coupled to the shield portion 128 and/or the housing portion 126. In other alternative embodiments, the connector assembly 102 may be provided without the spring beams 170, or springs or biasing elements of other types may be utilized to secure the connector assembly 102 to the panel 108.

The body 120 includes a locking finger 180 extending from the top side 138. A similar locking finger also extends from the bottom side 140, but is not shown in FIG. 2. One locking finger 180 is illustrated in the embodiment shown in FIG. 2, however any number of locking fingers 180 may be provided in alternative embodiments. The locking finger 180 is positioned between the spring beams 170, such as proximate to a center of the top side 138. The locking finger 180 may be positioned elsewhere in alternative embodiments, such as proximate one of the first or second sides 142, 144. As described in further detail below, the locking finger 180 cooperates with the panel 108 to secure a relative position of the connector assembly 102 with respect to the panel 108 after the connector assembly 102 is mounted to the panel 108. The locking finger 180 defines a cantilevered beam that is attached to the body 120 at a fixed end 182. A distal end 184 of the locking finger 180 is freely movable and is configured to engage the panel 108 when the connector assembly 102 is mounted to the panel 108.

The locking finger 180 is angled outward from the body 120 such that the distal end 184 is spaced apart from the top side 138. In an exemplary embodiment, the locking finger 180 is integrally formed with the shield portion 128 of the body 120. In alternative embodiments, the locking finger 180 may be integrally formed with the housing portion 126 or may be separately formed and coupled to the shield portion 128 and/or the housing portion 126. In other alternative embodiments, the connector assembly 102 may be provided without the locking finger 180, or locking or latching elements of other types may be utilized to position the connector assembly 102 with respect to the panel 108.

Figure 3:
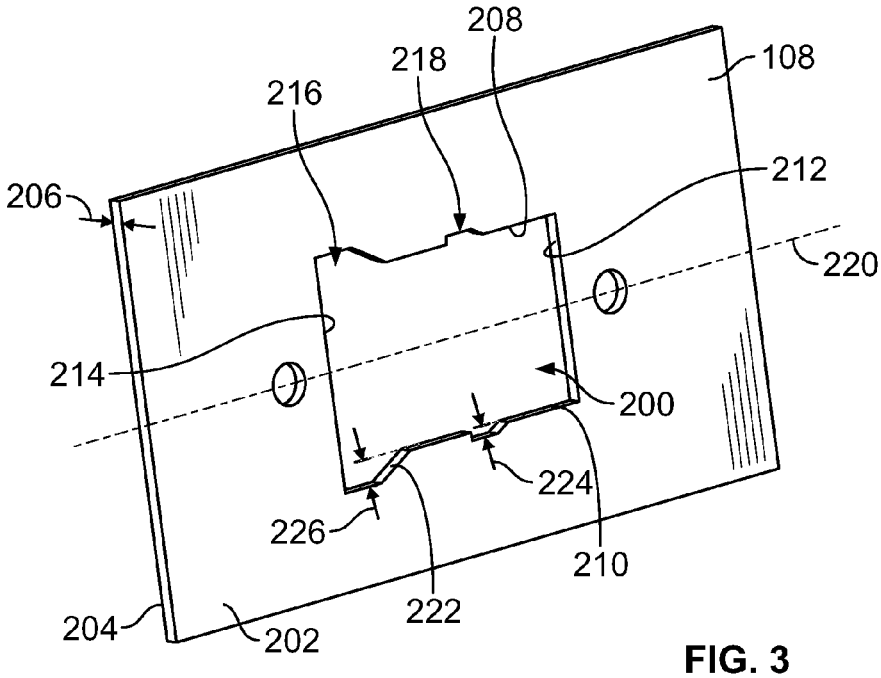
FIG. 3 is a front perspective view of a panel that is part of the system shown in FIG. 1.

FIG. 3 is a front perspective view of the panel 108 for the system 100 (shown in FIG. 1). The panel 108 is generally planar and includes a cutout 200 that is configured to receive the connector assembly 102 (shown in FIG. 1). The panel 108 also includes a front surface 202 that is forward facing, and a rear surface 204 that is rearward facing. The panel 108 has a thickness 206 defined between the front and rear surfaces 202, 204. The cutout extends along, and within, the plane defined by the panel 108.

Terms such as forward facing or positioned forward of or in front of generally refer to a direction toward the exterior of the system 100, and terms such as rearward facing or positioned rearward of or behind generally refer to a direction toward the interior of the system 100.

The cutout 200 illustrated in FIG. 3 is one exemplary embodiment that may be used with the connector assembly 102 illustrated in the Figures. However, the cutout 200 may be sized and/or shaped differently depending on the size, shape and various features of the connector assembly 102.

The cutout 200 defines a window through which the connector assembly 102 is loaded. As described in further detail below, the connector assembly 102 may be front loaded (e.g. loaded from the front) or rear loaded (e.g. loaded from the rear) through the cutout 200 in the panel 108. The cutout 200 has a similar shape as the outer perimeter of the connector assembly 102. For example, the cutout 200 may have an upper edge 208, a lower edge 210 and first and second side edges 212 and 214 that generally face the top, bottom, first and second sides 138-144 (shown in FIG. 2), respectively, of the connector assembly 102. In an exemplary embodiment, the upper edge 208 and the lower edge 210 are separated by a substantially similar distance as the top and bottom sides 138, 140. Optionally, the upper and lower edges 208, 210 engage the top and bottom sides 138, 140 of the connector assembly 102 when assembled. In an exemplary embodiment, the side edges 212, 214 are separated by a greater distance than the first and second sides 142, 144. As such, and as will be described in further detail below, the cutout 200 may accommodate the connector assembly 102 during loading and mating of the connector assembly 102 with the panel 108. For example, and as will be described in further detail below, the connector assembly 102 may be initially loaded into the cutout 200 and then moved or shifted to a mated position. Optionally, the first side 142 may engage the first side edge 212 of the cutout 200 when the connector assembly 102 is in the mated position.

In an exemplary embodiment, the cutout 200 includes a plurality of flange notches 216 and finger notches 218, which may be an optional feature depending on the inclusion and orientation of the locking finger 180 (shown in FIG. 2). The notches 216, 218 extend radially outward from the top and bottom edges 208, 210 defining the main window that receives the connector assembly 102. In the illustrated embodiment, the flange notches 216 are positioned at the second side edge 214 and the cutout 200 has a generally T-shape with a body of the T-shaped opening extending along a longitudinal axis 220 and the flange notches 216 defining legs of the T-shape extending laterally outward. The flange notches 216 are sized and shaped to accommodate the top and bottom flanges 160, 162 (shown in FIG. 2) of the connector assembly 102 during assembly. In an exemplary embodiment, a transition edge 222 is formed between the flange notches 216 and the respective upper and lower edges 208, 210. The transition edge 222 may be radiused or curved, or alternatively, may extend perpendicularly from the upper and lower edges 208, 210. The finger notches 218 are sized and positioned to receive the locking fingers 180 when the connector assembly 102 is in the mated position. The finger notches 218 are more shallow than the flange notches 216. For example, the finger notches 218 may have a first depth 224 and the flange notches 216 may have a second depth 226 that is deeper than the first depth 224.

Figure 4:
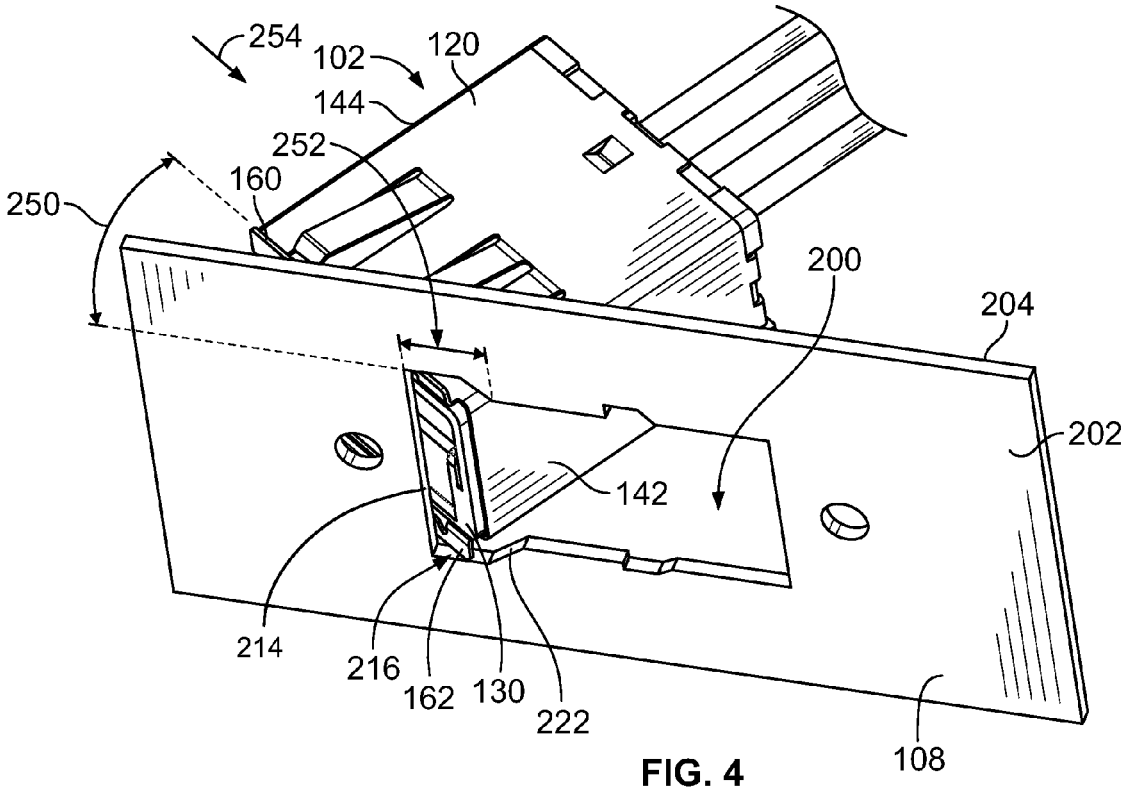
FIG. 4 is a front perspective view of the connector assembly shown in FIG. 2 being mounted to the panel shown in FIG. 3 in an initial stage of assembly.

FIG. 4 is a front perspective view of the connector assembly 102 being mounted to the panel 108 in an initial stage of assembly. The assembly process illustrated in FIG. 4 is a rear loading operation wherein the connector assembly 102 is loaded from the rear of the panel 108.

During assembly, the connector assembly 102 is initially loaded into the cutout 200 by positioning the first side 142 of the body 120 at the mating end 130 into the cutout 200. In particular, the top and bottom flanges 160, 162 are loaded into the flange notches 216. Generally, for rear loading, the connector assembly 102 only fits into the cutout 200 by aligning the flanges 160, 162 with the flange notches 216. The overall height of the body 120 at the flanges 160, 162 is taller than the height of the main portion of the cutout 200, but the height of the cutout 200 at the flange notches 216 is tall enough to accommodate the body 120 and the flanges 160, 162.

When the connector assembly 102 is initially loaded into the cutout 200, the connector assembly is angled with respect to the panel 108. For example, the mating end 130 of the body 120 is oriented at a loading angle 250, such as an acute angle, with respect to the panel 108. The angle 250 may be defined by a width 252 of the flange notch 216. For example, when loaded, a rear surface of each flange 160, 162 engages the front surface 202 of the panel 108 proximate the transition edge 222 and a front surface of each flange 160, 162 engages the rear surface 204 of the panel 108 proximate the second side edge 214. By increasing the width 252 of the flange notches 216, the angle 250 may be reduced as the mating end 130 may be positioned generally closer to parallel to the panel 108.

In some embodiments, the loading angle 250 may be a range of angles. For example, the minimum angle may be defined by the situation in which the rear and front surfaces of the flanges 160, 162 engage the front and rear surfaces 202, 204 of the panel 108. However, the connector assembly 102 may be loaded through the cutout 200 at other angles that are greater than the minimum loading angle, such as by moving the second side 144 generally away from the rear surface 204 of the panel 108, such as closer to an angle in which the mating end 130 is perpendicular to the panel 108. In an exemplary embodiment, the loading angle 250 may be between approximately 30 and 60 degrees. Optionally, the loading angle 250 may be approximately 45 degrees. In some embodiments, the loading angle 250 may be between approximately 0 and 90 degrees.

After the connector assembly 102 is initially loaded into the cutout 200, loading of the connector assembly 102 is accomplished by moving the connector assembly 102 in a loading direction, represented by the arrow 254. For example, pushing on the second side 144 of the body 120 forces the connector assembly 102 to move in the loading direction 254. The loading direction 254 is generally oriented along the loading angle 250. The loading direction 254 is generally a linear direction. Optionally, the loading direction 254 may change during loading, such as when the loading angle 250 is changed.

Figure 5:
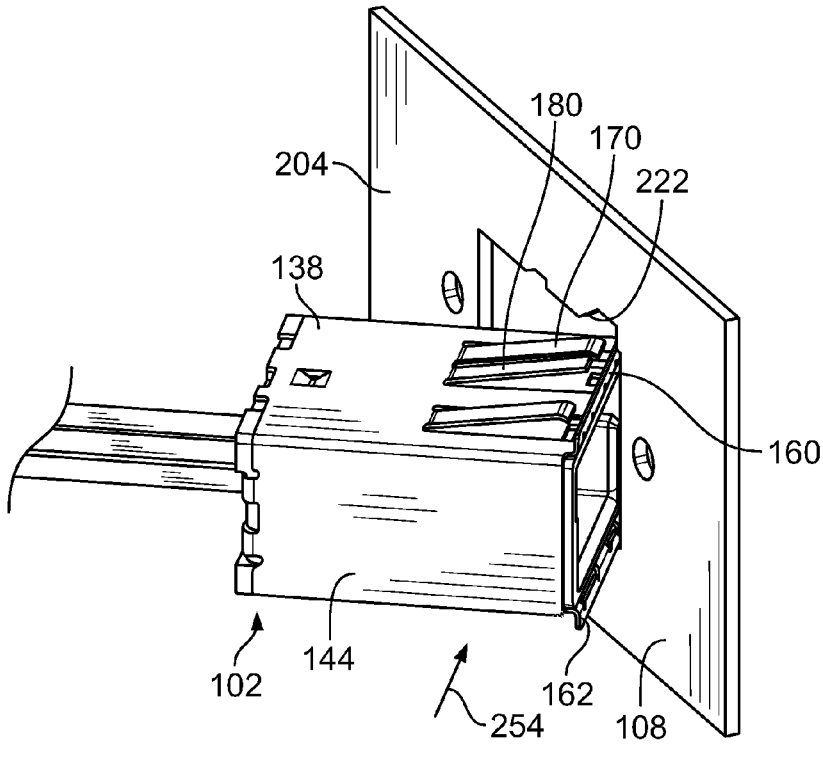
FIG. 5 is a rear perspective view of the connector assembly and the panel in the initial stage of assembly.

FIG. 5 is a rear perspective view of the connector assembly 102 and the panel 108 in the initial stage of assembly. FIG. 5 illustrates the loading direction 254 as being generally perpendicular to the second side 144. Once positioned in the initial loading position, at least a portion of each flange 160, 162 is positioned in front of the panel 108 and at least a portion of each flange 160, 162 is positioned behind the panel 108.

The spring fingers 170 and the locking finger 180 are illustrated in FIG. 5 with respect to the cutout 200. As the spring fingers 170 and locking finger 180 are spaced apart from the top surface 138, the spring fingers 170 and locking finger 180 are configured to engage the rear surface 204 of the panel 108 as the connector assembly 102 is transitioned from the initial loading position along the loading direction. However, the transition edge 222 is adapted to engage the spring fingers 170 and the locking finger 180 and deflect the spring fingers 170 and locking finger 180 toward the top side 138. The surface of the transition edge 222 facilitates deflection of the spring fingers 170 and the locking finger 180, as compared to a transition edge 222 that is generally vertically oriented.

Figure 6:
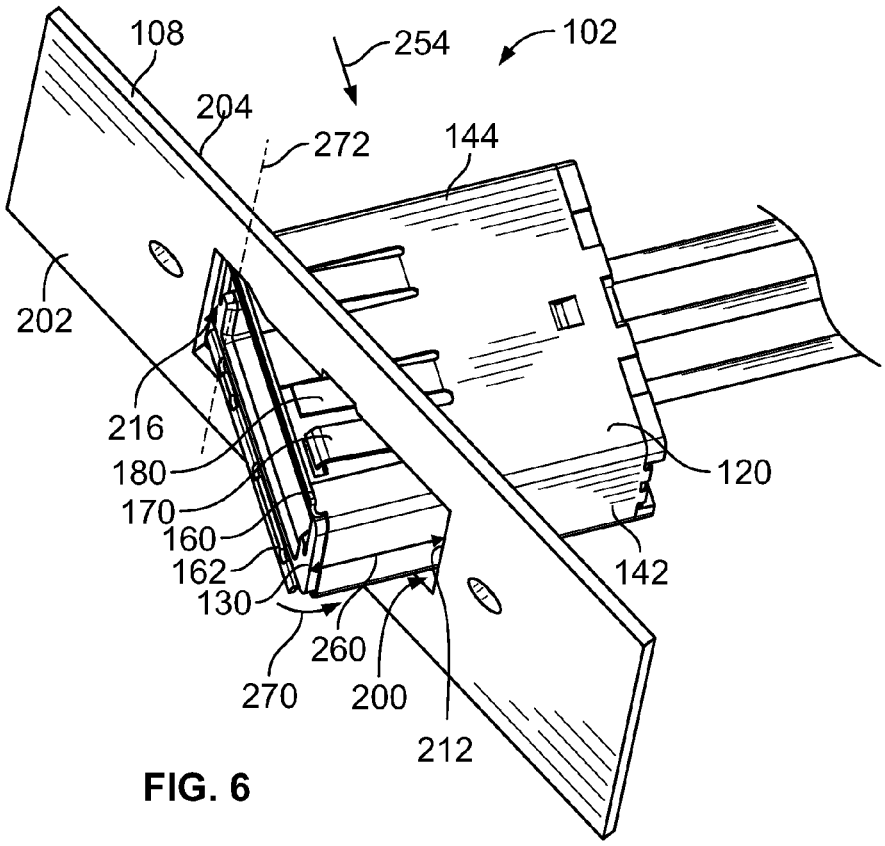
FIG. 6 is a top perspective view of the connector assembly and the panel in an intermediate stage of assembly.

FIG. 6 is a top perspective view of the connector assembly 102 and the panel 108 in an intermediate stage of assembly illustrating the connector assembly 102 in a loaded position. As described above, the connector assembly 102 is transitioned to the loaded position from the initially loaded position shown in FIGS. 4 and 5 by moving the connector assembly 102 in the loading direction 254.

In the loaded position, the first side 142 of the body 120 engages the first side edge 212 of the cutout 200. The portion of the first side 142 that engages the first side edge 212 is located remote with respect to the mating end 130 of the body 120, such as at a location proximate a center of the first side 142. In the loaded position, the mating end 130 of the body 120 at the second side 144 is substantially aligned with the second side edge 216 of the cutout 200. In an exemplary embodiment, the corner of the body 120 defined at the mating end 130 and the second side 144 may be cleared beyond the rear surface 204 and/or the front surface 202 of the panel 108.

In the loaded position, the corner of the body 120 defined at the mating end 130 and the first side 142 is positioned a distance 260 from the front surface 202 of the panel 108. The distance 260 may be controlled by the loading angle 250 (shown in FIG. 4). In the loaded position, the spring fingers 170 and/or the locking finger 180 may be positioned generally forward of the panel 108.

Once the connector assembly 102 is in the loaded position, the connector assembly 102 may be transitioned to a mated position (shown in FIG. 7) by transitioning the connector assembly 102 in a mating direction, shown by the arrow 270 in FIG. 6. The mating direction 270 is arcuate, wherein the first side 142 of the body 120 is pivoted or rotated toward the panel 108. A pivot axis 272 is defined at the transition edge 222 by the intersection of the flanges 160, 162 and the respective transition edge 222. The connector assembly 102 is moved in the mating direction until the flanges 160, 162 engage the front surface 202 of the panel 108.

Figure 7:
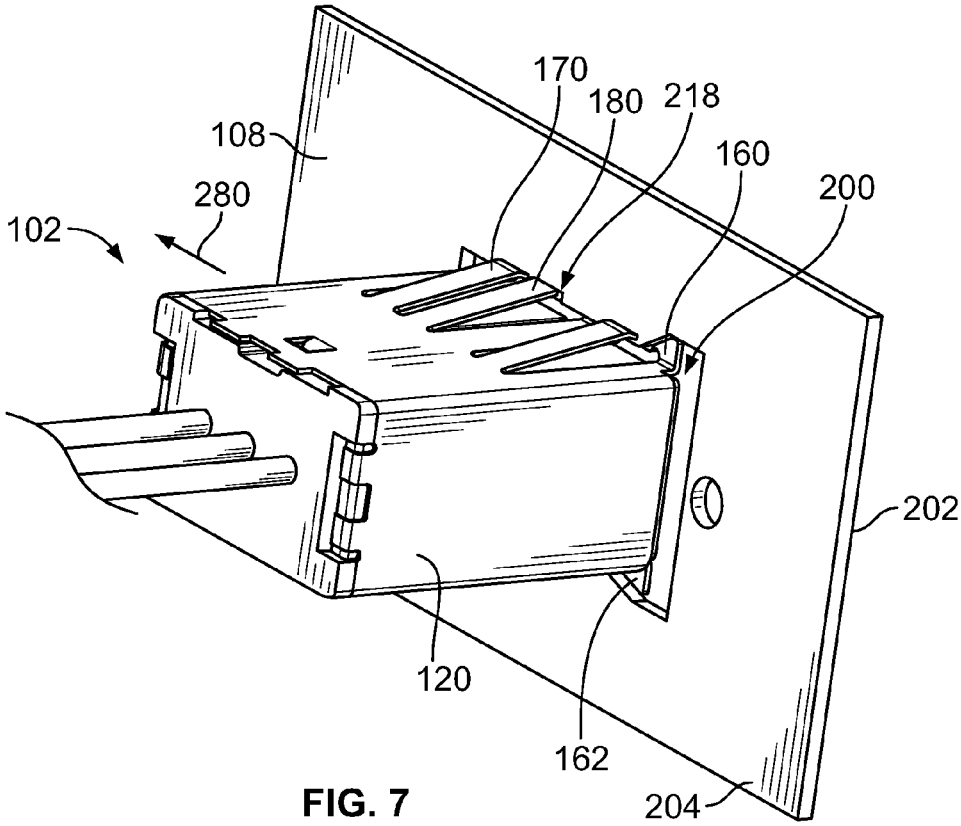
FIG. 7 is a rear perspective view of the connector assembly and the panel in a final stage of assembly.

FIG. 7 is a rear perspective view of the connector assembly 102 and the panel 108 in a final stage of assembly in which the connector assembly 102 is in a mated position. In the mated position, the flanges 160, 162 engage the front surface 202 of the panel 108 and the spring beams 170 engage the rear surface 204 of the panel 108. The spring beams 170 may be resilient and/or flexible such that, when the spring beams 170 engage the rear surface 204, the spring beams 170 are at least partially deflected and bias against the rear surface 204 to hold the flanges 160, 162 against the front surface 202 of the panel.

During assembly, when the connector assembly 102 is transitioned from the loaded position (shown in FIG. 6) to the mated position (shown in FIG. 7), the longitudinal position of the connector assembly 102 within the cutout 200 may or may not be proper. As described above, the cutout 200 is larger than the body 120 to accommodate the loading operation. As such, the connector assembly 102 may be movable side to side within the cutout 200. The inclusion of the locking finger 180 and the locking notch 218 allows the position of the connector assembly 102 to be fixed relative to the cutout 200. For example, when the connector assembly 102 is moved in a locking direction, shown in FIG. 7 by the arrow 280, the locking finger 180 may be aligned with the locking notch 218. When the locking finger 180 is received in the locking notch 218, movement of the connector assembly 102 in a direction along the longitudinal axis 148 may be restricted. The locking fingers 180 may be deflected toward the connector body 120 and out of the locking notches 218 to allow removal of the connector assembly 102 from the panel 108.

Figure 8:
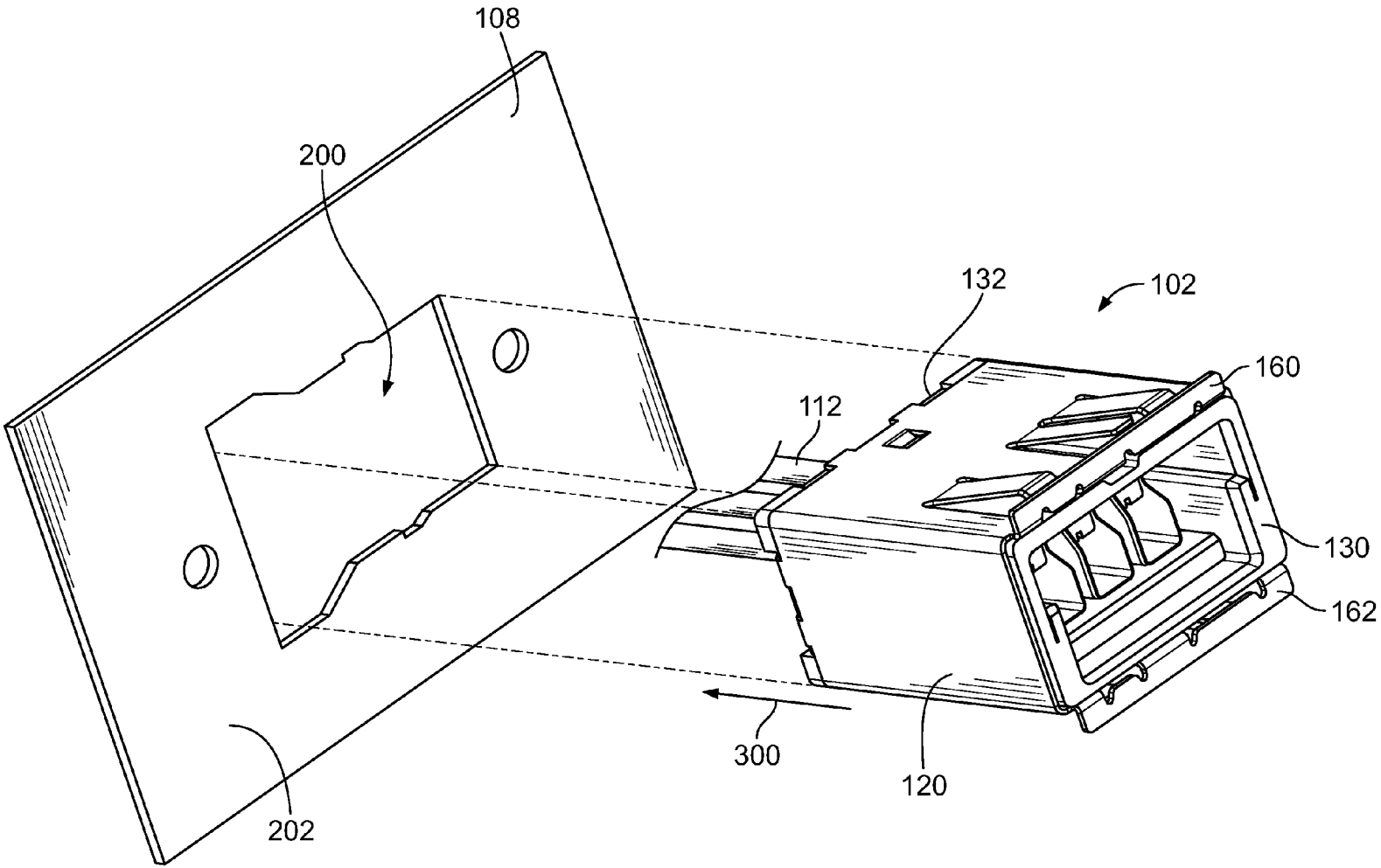
FIG. 8 is a front perspective view of the connector assembly and the panel during an alternative assembly operation.

FIG. 8 is a front perspective view of the connector assembly 102 and the panel 108 during an alternative assembly operation. FIG. 8 illustrates a front loading operation, in which the connector assembly 102 is loaded into the cutout 200 from the front of the panel 108. In the front loading operation, the connector assembly 102 is aligned with the cutout 200. The connector assembly 102 is loaded into the cutout 200 in a front loading direction, shown in FIG. 8 by the arrow 300. In an exemplary embodiment, the front loading direction 300 is generally perpendicular to the panel 108. The connector assembly 102 is loaded straight into the cutout 200 to the mated position, which is shown in FIG. 7.

During loading, the cable end 132 of the body 120 is initially loaded through the cutout 200 in the panel 108. The connector assembly 120 is loaded until the flanges 160, 162 at the mating end 130, which is opposite to the cable end 132, engage the front surface 202 of panel 108. The lines 112 may be preloaded through the cutout 200. Alternatively, the lines 112 may be connected to the connector assembly 102 after the connector assembly 102 is mounted to the panel 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a planar panel having a front surface and a rear surface, the panel having a cutout extending along and within the panel between the front and rear surfaces, the cutout having a flange notch off-set at one side of the cutout; and a connector having a body including sides defining a perimeter configured to fit within the cutout, the connector includes a flange extending outward from one of the sides of the body, the flange being configured to engage a front surface of the panel to define a stop against the panel when the connector is in a mated position, wherein the connector is sized and shaped to be both front loaded and rear loaded through the cutout, when front loaded, the connector is passed through the cutout from a front of the panel to the mated position, when rear loaded, the connector is passed through the cutout from a rear of the panel to the mated position with the flange passing through the flange notch until the flange is positioned forward of the front surface of the panel.

2. The connector assembly of claim 1, wherein the body includes at least two flanges, each flange having an engagement surface being substantially coplanar with each other engagement surface, the engagement surfaces configured to engage the front surface of the panel, the panel having a plurality of flange notches aligned with one another on the same side of the cutout, the flanges passing through corresponding flange notches when the connector is rear loaded.

3. The connector assembly of claim 1, wherein the connector is loaded through the cutout at an acute angle when the connector is rear loaded such that the flange is oriented at an acute angle with respect to the front surface of the panel until substantially the entire flange passes through the cutout.

4. The connector assembly of claim 1, wherein the cutout has a height and a width, the cutout being oversized with the width being wider than a width of the connector, the height of the cutout in the area of the flange notch being greater than the height of the cutout in an adjacent area.

5. The connector assembly of claim 1, wherein the cutout has a height measured between a top and a bottom and a width measured between opposite sides, the cutout being oversized with the width being wider than a width of the connector, the cutout having a locking notch in at least one of the top and the bottom of the cutout, the connector having a locking finger extending into the locking notch when the connector is in the mated position, at least one of the sides of the connector being held spaced apart from the corresponding side of the cutout when the connector is in the mated position, the locking finger holding the side-to-side location of the connector within the cutout.

6. A connector assembly adapted for mounting to a panel having a cutout, the cutout having a flange notch defining a perimeter that is larger than a perimeter of the cutout adjacent the flange notch, the connector assembly comprising:

a connector having a body including a front surface and sides surrounding the front surface, the sides defining a perimeter configured to fit within the cutout, the connector includes a flange extending outward from one of the sides of the body at the front surface, the flange including a first end and a second end facing opposite sides of the body, wherein the connector is configured to be loaded through the cutout in a loading direction by orienting the connector such that the front surface is angled at an acute angle with respect to a plane of the panel and initially loading the first end of the flange through the flange notch from a rear of the panel to a front of the panel and then moving the connector in the loading direction, the loading direction is defined at a non-orthogonal angle with respect to the plane of the panel, the connector being loaded in the loading direction to a loaded position in which the second end of the flange has clearance from a rear surface of the panel, and wherein the connector is moved from the loaded position to a mated position in a mating direction in which the first end is moved toward the front surface.

7. The connector assembly of claim 6, wherein the connector is rotated in the mating direction from the loaded position to the mated position.

8. The connector assembly of claim 6, wherein the flange notch is defined by a transition edge, wherein the flange engages the transition edge as the connector is loaded in the loading direction.

9. The connector assembly of claim 8, wherein the flange is oriented at an acute angle with respect to the transition edge as the connector is loaded in the loading direction.

10. The connector assembly of claim 6, wherein the connector includes at least one spring beam associated with the flange, each spring beam engages the rear surface of the panel and the flange engages the front surface of the panel when the connector is in the mated position.

11. The connector assembly of claim 6, wherein the cutout is oversized and wider than a width of the connector, the cutout includes a locking notch, and wherein the connector includes a locking finger configured to extend into the locking notch when the connector is in the mated position to hold a side-to-side position of the connector within the cutout.

12. The connector assembly of claim 6, wherein the connector includes a second flange opposite the flange, and wherein the cutout includes first and second flange notches, the flange and the second flange are configured to be loaded through the first and second flange notches during loading in the loading direction.

13. A connector assembly comprising:

a planar panel having a front surface and a rear surface, the panel having a cutout extending along and within the panel between the front and rear surfaces, wherein the cutout includes first and second flange notches; and a connector having a body including sides defining a perimeter configured to fit within the cutout, the connector includes a first flange extending outward from one of the sides of the body and a second flange extending outward from an opposite one of the sides of the body, the first and second flanges being rigid walls extending from the corresponding sides, the connector being mounted to the panel in a mated position such that the first and second flanges engage the front surface of the panel, wherein the connector is sized and shaped to be both front loaded and rear loaded through the cutout, when front loaded, the connector is loaded through the cutout from a front of the panel to the mated position, when rear loaded, the connector is loaded through the cutout from a rear of the panel to the mated position with the first and second flanges passing through the first and second flange notches as the connector is rear loaded.

14. The connector assembly of claim 13, wherein the connector is loaded through the cutout at a loading angle that is angled at an acute angle with respect to a plane defined by the panel.

15. The connector assembly of claim 13, wherein the connector includes a mating end, the mating end being angled at an acute angle with respect to the front surface of the panel during a loading operation when the connector is rear loaded, and wherein the mating end is parallel to the front surface in the mated position.

16. The connector assembly of claim 13, wherein the cutout has a height and a width, the cutout being oversized with the width being wider than a width of the connector, the cutout having flange notches off-set at one side of the cutout, the first and second flanges passing through the flange notches when the connector is rear loaded.

17. The connector assembly of claim 13, wherein the cutout has a height measured between a top and a bottom and a width measured between opposite sides, the cutout being oversized with the width being wider than a width of the connector, the cutout having a locking notch in at least one of the top and the bottom of the cutout, the connector having a locking finger extending into the locking notch when the connector is in the mated position, at least one of the sides of the connector being held spaced apart from the corresponding side of the cutout when the connector is in the mated position, the locking finger holding the side-to-side location of the connector within the cutout.

18. The connector assembly of claim 13, wherein front loading of the connector includes loading the connector in a loading direction generally perpendicular to the front surface of the panel, and wherein rear loading of the connector includes loading the connector in a loading direction at an acute angle with respect to the front surface.

19. The connector assembly of claim 13, wherein the mated position of the connector with respect to the panel is the same when the connector is front loaded and when the connector is rear loaded.

20. The connector assembly of claim 13, wherein the connector includes at least one spring beam associated with each of the first and second flanges, each spring beam engages a rear surface of the panel, wherein the panel is held between the spring beam and the first and second flanges.

21. The connector assembly of claim 13, wherein the first and second flanges extend along at least a majority of the corresponding sides.

* * * * *